US006134810A

United States Patent [19]

Stockley

[11] Patent Number: 6,134,810

[45] Date of Patent: Oct. 24, 2000

[54] WASHING MACHINE INSERT

[76] Inventor: Philip E. Stockley, 3 Grassmere Avenue, Swinton, Manchester M27 9GP, United Kingdom

[21] Appl. No.: 09/271,847

[22] Filed: Mar. 18, 1999

[51] Int. Cl.[7] ..... F26B 11/02

[52] U.S. Cl. ..... 34/600; 68/235 R; 68/189

[58] Field of Search ..... 34/90, 104, 109, 34/202, 204, 237, 239, 240, 596, 597, 600, 606; 68/12.02, 12.09, 12.14, 12.15, 18 C, 20, 235 R, 189; 15/3, 210.1, 90; D32/36, 58

[56] References Cited

U.S. PATENT DOCUMENTS

| | | | |
|---|---|---|---|
| D. 259,304 | 5/1981 | Ball | D3/36 |
| 4,109,397 | 8/1978 | Daily | 34/239 |
| 4,617,743 | 10/1986 | Barnard | 34/109 |
| 4,691,400 | 9/1987 | Arneson | 15/3 |
| 5,024,408 | 6/1991 | Magee | 248/206.5 |
| 5,158,220 | 10/1992 | Glass | 224/209 |
| 5,220,734 | 6/1993 | Carver | 34/239 X |
| 5,546,678 | 8/1996 | Dhaemers | 34/60 X |
| 5,743,025 | 4/1998 | Jordan, Jr. | 34/600 |

*Primary Examiner*—Stephen Gravini

[57] ABSTRACT

A washing machine insert for holding athletic shoes therein when washing the athletic shoes in a washing machine. The washing machine insert includes a member designed for insertion into a washing tub of a front loading style washing machine. The member has a plurality of bores extending therethrough between a pair of opposite faces of the member. Each of the bores is designed for receiving a shoe therein.

7 Claims, 2 Drawing Sheets

WASHING MACHINE INSERT

BACKGROUND OF THE INVENTION

1. Field of the Invention

The present invention relates to devices for washing athletic shoes and more particularly pertains to a new washing machine insert for holding athletic shoes therein when washing the athletic shoes in a washing machine.

2. Description of the Prior Art

The use of devices for washing athletic shoes is known in the prior art. More specifically, devices for washing athletic shoes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,743,025; U.S. Pat. No. 3,316,659; U.S. Pat. No. Des. 335,008; U.S. Pat. No. 4,617,743; U.S. Pat. No. 3,344,532; and U.S. Pat. No. 4,109,397.

While these devices fulfill their respective, particular objectives and requirements, the aforementioned patents do not disclose a new washing machine insert. The inventive device includes a member designed for insertion into a washing tub of a front loading style washing machine. The member has a plurality of bores extending therethrough between a pair of opposite faces of the member. Each of the bores is designed for receiving a shoe therein.

In these respects, the washing machine insert according to the present invention substantially departs from the conventional concepts and designs of the prior art, and in so doing provides an apparatus primarily developed for the purpose of holding athletic shoes therein when washing the athletic shoes in a washing machine.

SUMMARY OF THE INVENTION

In view of the foregoing disadvantages inherent in the known types of devices for washing athletic shoes now present in the prior art, the present invention provides a new washing machine insert construction wherein the same can be utilized for holding athletic shoes therein when washing the athletic shoes in a washing machine.

The general purpose of the present invention, which will be described subsequently in greater detail, is to provide a new washing machine insert apparatus and method which has many of the advantages of the devices for washing athletic shoes mentioned heretofore and many novel features that result in a new washing machine insert which is not anticipated, rendered obvious, suggested, or even implied by any of the prior art devices for washing athletic shoes, either alone or in any combination thereof.

To attain this, the present invention generally comprises a member designed for insertion into a washing tub of a front loading style washing machine. The member has a plurality of bores extending therethrough between a pair of opposite faces of the member. Each of the bores is designed for receiving a shoe therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washing machine insert apparatus and method which has many of the advantages of the devices for washing athletic shoes mentioned heretofore and many novel features that result in a new washing machine insert which is not anticipated, rendered obvious, suggested, or even implied by any of the prior art devices for washing athletic shoes, either alone or in any combination thereof.

It is another object of the present invention to provide a new washing machine insert which may be easily and efficiently manufactured and marketed.

It is a further object of the present invention to provide a new washing machine insert which is of a durable and reliable construction.

An even further object of the present invention is to provide a new washing machine insert which is susceptible of a low cost of manufacture with regard to both materials and labor, and which accordingly is then susceptible of low prices of sale to the consuming public, thereby making such washing machine insert economically available to the buying public.

Still yet another object of the present invention is to provide a new washing machine insert which provides in the apparatuses and methods of the prior art some of the advantages thereof, while simultaneously overcoming some of the disadvantages normally associated therewith.

Still another object of the present invention is to provide a new washing machine insert for holding athletic shoes therein when washing the athletic shoes in a washing machine.

Yet another object of the present invention is to provide a new washing machine insert which includes a member designed for insertion into a washing tub of a front loading style washing machine. The member has a plurality of bores extending therethrough between a pair of opposite faces of the member. Each of the bores is designed for receiving a shoe therein.

Still yet another object of the present invention is to provide a new washing machine insert that protects athletic shoes when being washed in a washing machine from being scuffed up by other athletic shoes being washed at the same time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 5 thereof, a new washing machine insert embodying the principles and concepts of the present invention will be described.

As best illustrated in FIGS. 1 through 5, the washing machine insert generally comprises a member designed for insertion into a washing tub of a front loading style washing machine. The member has a plurality of bores extending therethrough between a pair of opposite faces of the member. Each of the bores is designed for receiving a shoe therein.

In closer detail, the insert comprises a generally cylindrical member 10 having a spaced apart pair of opposite generally circular faces 11,12, a generally cylindrical outer side 13 between the faces of the member, and a center axis extending between the faces of the member. The member comprises a resiliently deformable foamed material such as a sponge material with a plurality of apertures therein to permit passage and absorption of water through and into the member. The member is divided into a plurality of generally equal sized and generally pie wedge-shaped sectors extending between the faces of the member. Preferably, the plurality of sectors of the member comprises four sectors.

Figure 3:
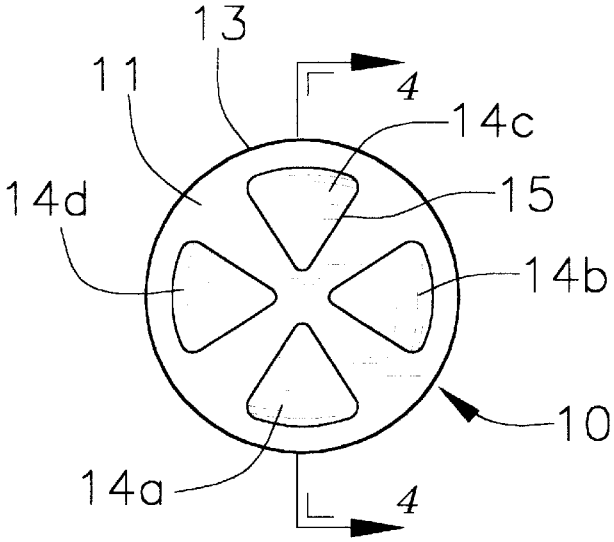
FIG. 3 is a schematic plan view of one face of the present invention.

The member has a plurality of bores 14*a*,14*b*,14*c*,14*d* extending therethrough between the faces of the member. In the preferred embodiment, the plurality of bores comprises four bores. With particular reference to FIG. 3, each of the bores has a generally triangular or pie-wedge shaped transverse cross section taken generally perpendicular to the central axis of the member.

Figure 2:
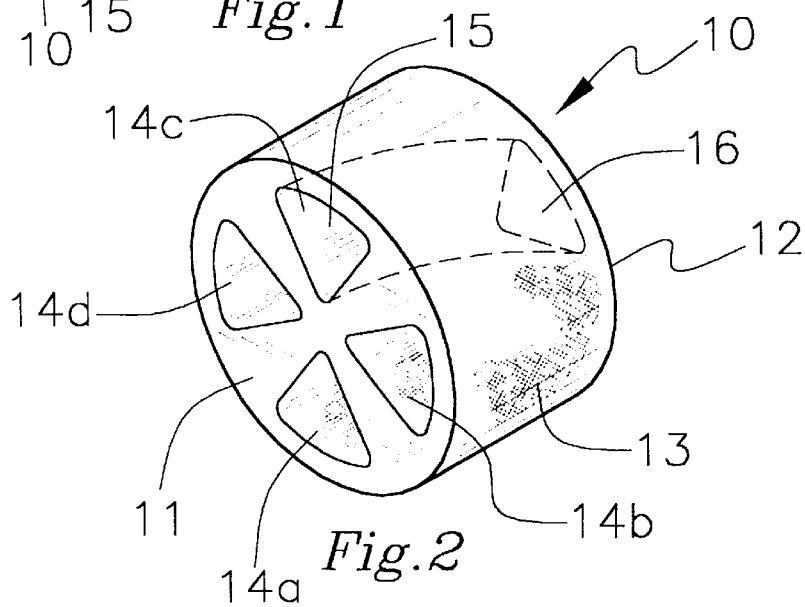
FIG. 2 is a schematic perspective view of the present invention.
Figure 4:
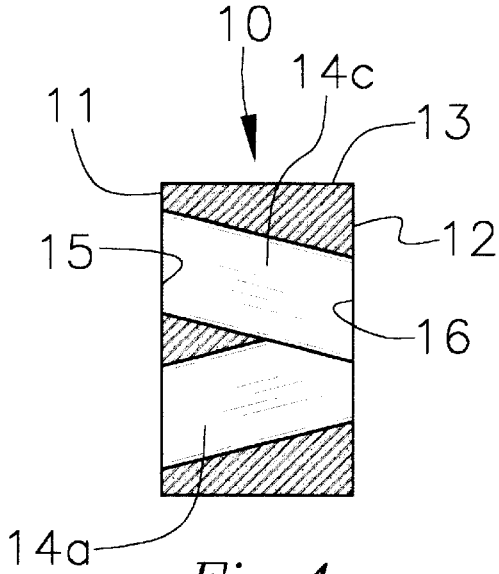
FIG. 4 is a schematic cross sectional view of the present invention taken from line 4—4 of FIG. 3.

Each of the bores has a pair of opposite openings 15,16 therein, and a longitudinal axis extending between the openings of the respective bore. A first 15 of the openings of each bore is located at a first of the faces of the member and a second 16 of the openings of each bore is located at a second of the faces of the member. With particular reference to FIGS. 2 and 4, in the preferred embodiment, the first opening of each bore is positioned on the first face of the member in a first unique associated region of the member. In this embodiment, the second opening of each bore is positioned on the second face of the member in a second unique region adjacent the first unique region of the first opening of the respective bore so that the longitudinal axis of each bore is extended at an oblique angle to the central axis of the member as shown in FIG. 4. The longitudinal axes of the bores each is extended at an acute angle to the first face and the second face of the member. In use, this arrangement is designed to give each of the bores a longer length than the depth of the member defined between the faces of the member. This allows longer shoes to fit into each bore than would be allowable if the longitudinal axes of the bores were extended parallel to the central axis of the member.

In use, at least one athletic shoe 17 is inserted into one of the bores. Each of the bores is preferably designed for receiving a pair of athletic shoes therein oriented heel to toe or toe to toe in the respective bore with the soles of the athletic shoes facing radially outwards from the central axis of the member and the ankle opening of the athletic shoe facing radially inwardly towards the central axis of the member. Each shoe has a size slightly larger than the dimensions of the transverse cross section of the bore so that the athletic shoe deforms adjacent portions of the member when inserted into the associated bore so that the athletic shoe is held in the bore by the counteracting resilient forces of the compressed portions of the member directed towards shoe in the bore.

Figure 1:
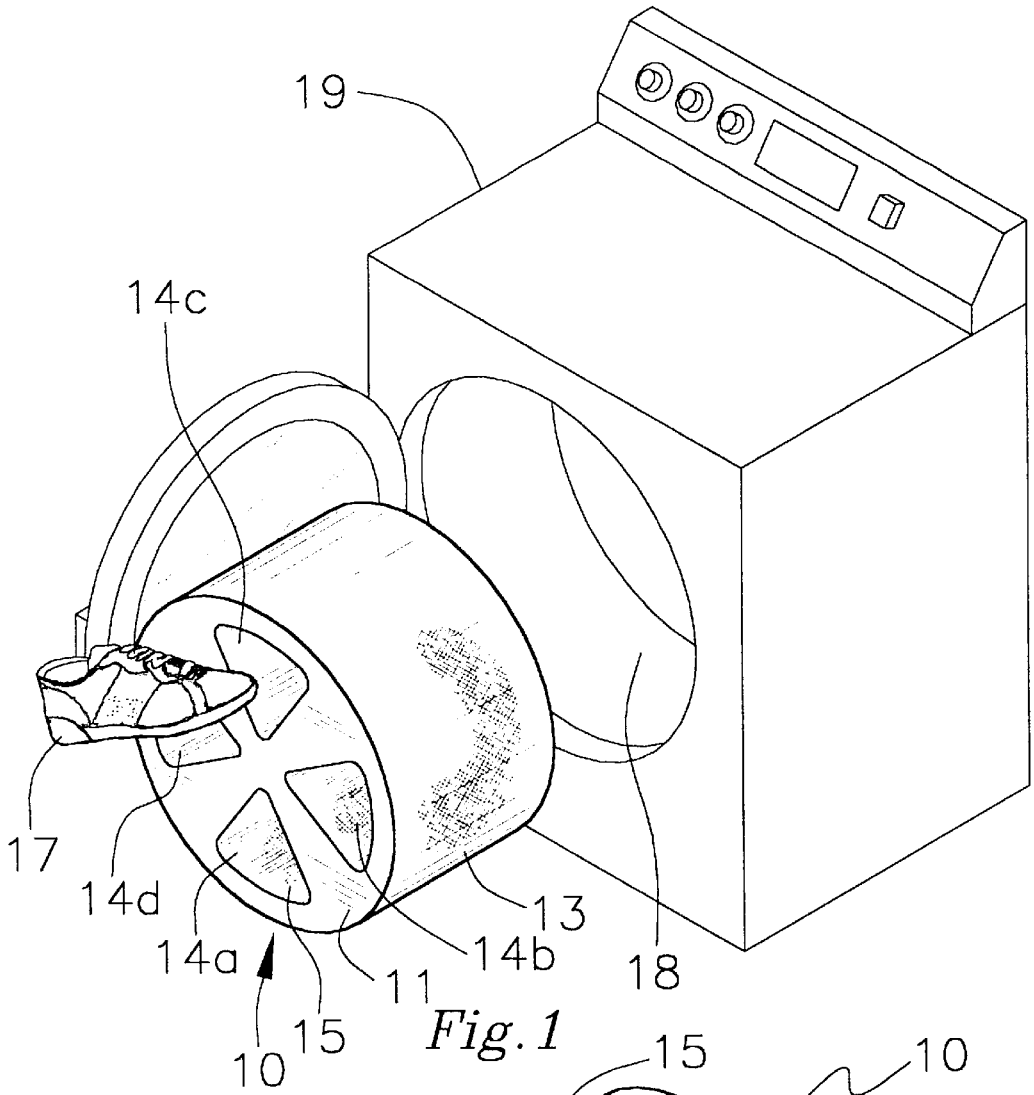
FIG. 1 is a schematic perspective view of a new washing machine insert with an athletic shoe and a front loading washing machine according to the present invention.

With reference to FIG. 1, the member may then be inserted into a generally cylindrical washing tub 18 of a front loading style washing machine 19 such that the washing tub and the member are generally coaxial and one of the faces of the member faces in an outwardly direction from a front opening of the washing tub. The member has a depth defined between the faces of the member and an outer diameter defined substantially perpendicular to the central axis of the member. The washing tub has an inner diameter. Preferably, the outer diameter of the member is slightly greater than the inner diameter of the washing tub such that the member is compressed radially inwards by the washing tub when the member is inserted into the washing tub. The washing machine may then be activated to wash the athletic shoes with the insert in the washing tub. After washing, the insert may be removed and the shoe then removed from the insert for drying of the shoes.

For typically sized front loading style washing machines, the depth of the member is ideally about 10 inches, and the diameter of the member is about 18 inches. The triangular transverse cross section of each bore has a height defined radially inwards to the central axis of the member and a base width defined perpendicular to the height of the respective transverse cross section. In this ideal embodiment, the height of each transverse cross section is about 1 inch and the base width of each transverse cross section is between about 4 inches and about 5 inches.

Figure 5:
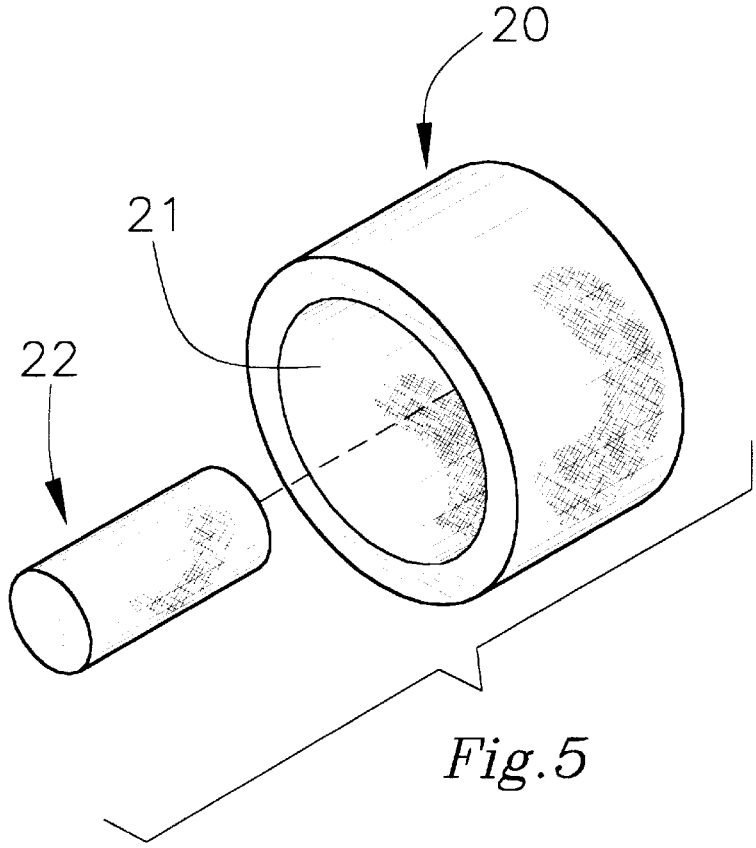
FIG. 5 is a schematic exploded perspective view of another preferred embodiment of the present invention.

FIG. 5 illustrates another preferred embodiment of the insert used in a similar fashion as the embodiment illustrated in FIGS. 1 through 4. This embodiment comprises a generally cylindrical outer member 20 similar to the member has a pair of generally circular opposite faces and generally coaxial and generally cylindrical inner and outer perimeter sides between the faces of the outer member. The inner perimeter side of the outer member defining a generally cylindrical central bore 21 through the outer member extending between the faces of the bore.

This embodiment further includes a generally cylindrical inner member 22 having a pair of generally circular opposite faces and an outer perimeter side. The inner and outer member each comprises the same a resiliently deformable foamed material as the member in the first preferred embodiment. The inner member is inserted into the central bore of the outer member such that one face of the inner member is generally coplanar with one face of the outer member, the other face of the inner member is generally coplanar with the other face of the outer member and the outer perimeter side of the inner member is spaced apart from the inner perimeter side of the outer member. The outer perimeter side of the inner member and the inner perimeter side of the outer member define an annular space in the central bore designed for receiving athletic shoes therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insert for holding shoes therein and for insertion into a generally cylindrical washing tub of a front loading-style washing machine, said insert comprising:

a member having a spaced apart pair of faces, and an outer side between said faces of said member;

said member having a plurality of bores extending therethrough between said faces of said member; and each of said bores having a pair of opposite openings therein, a first of said openings of each bore being located at a first of said faces of said member, a second of said openings of each bore being located at a second of said faces of said member, each of said bores being adapted for receiving a shoe therein; and wherein said first opening of each bore is positioned on said first face of said member in a first unique associated region of said member, and wherein said second opening of each bore is positioned on said second face of said member in a second unique region adjacent said first unique region of the first opening of the respective bore such that said longitudinal axis of each bore is extended at an oblique angle to said central axis of said member, said longitudinal axes of said bores each being extended at an acute angle to said first face and said second face of said member for moving water through each of said bores as said member is rotated in the washing machine.

2. The insert of claim 1, wherein said member comprises a resiliently deformable foamed material.

3. The insert of claim 1, wherein said member is divided into a plurality of generally equal sized sectors extending between said faces of said member, wherein said first opening of each bore is positioned on said first face of said member in a first unique associated region of said member, and wherein said second opening of each bore is positioned on said second face of said member in a second unique region adjacent said first unique region of the first opening of the respective bore.

4. The insert of claim 3, wherein said plurality of sectors of said member comprises four sectors, and wherein said plurality of bores comprises four bores.

5. The insert of claim 1, wherein each of said bores has a generally triangular transverse cross section taken generally perpendicular to a central axis of said member extending between said faces of said member.

6. An athletic shoe washing system, comprising:

a generally cylindrical member having a spaced apart pair of opposite generally circular faces, a generally cylindrical outer side between said faces of said member, and a center axis extending between said faces of said member;

said member comprising a resiliently deformable foamed material;

said member being divided into a plurality of generally equal sized and generally pie wedge-shaped sectors extending between said faces of said member;

wherein said plurality of sectors of said member comprises four sectors;

said member having a plurality of bores extending therethrough between said faces of said member, wherein said plurality of bores comprises four bores;

each of said bores having a generally triangular transverse cross section taken generally perpendicular to said central axis of said member;

each of said bores having a pair of opposite openings therein, and a longitudinal axis extending between said openings of the respective bore;

a first of said openings of each bore being located at a first of said faces of said member, a second of said openings of each bore being located at a second of said faces of said member;

said first opening of each bore being positioned on said first face of said member in a first unique associated region of said member, said second opening of each bore being positioned on said second face of said member in a second unique region adjacent said first unique region of the first opening of the respective bore so that said longitudinal axis of each bore is extended at an oblique angle to said central axis of said member, said longitudinal axes of said bores each being extended at an acute angle to said first face and said second face of said member;

at least one athletic shoe being inserted into one of said bores, wherein each of said bores is adapted for receiving a pair of athletic shoes therein;

a front loading style washing machine having a generally cylindrical washing tub therein, said member being inserted into said washing tub such that said washing tub and said member are generally coaxial and one of said faces of said member faces in an outwardly direction from a front opening of said washing tub;

said member having a depth defined between said faces of said member and an outer diameter defined substantially perpendicular to said central axis of said member;

said washing tub having an inner diameter;

wherein said outer diameter of said member is slightly greater than said inner diameter of said washing tub such that said member is compressed radially inwards by said washing tub when said member is inserted into said washing tub.

7. An insert for holding shoes therein and for insertion into a generally cylindrical washing tub of a front loading-style washing machine, said insert comprising:

a generally cylindrical outer member having a pair of generally circular opposite faces and generally coaxial and generally cylindrical inner and outer perimeter sides between said faces of said outer member such that said outer perimeter side of said member is adapted for engaging the cylindrical washing tub of the washing machine for prevent movement of said member is relation to the washing tub of the washing machine;

said inner perimeter side of said outer member defining a generally cylindrical central bore through said outer member extending between said faces of said bore;

a generally cylindrical inner member having a pair of generally circular opposite faces and an outer perimeter side;

said inner and outer member each comprising a resiliently deformable foamed material; and said inner member being inserted into said central bore of said outer member such that one face of said inner member is generally coplanar with one face of said outer member, the other face of the inner member is generally coplanar with the other face of the outer member and the outer perimeter side of the inner member is spaced apart from said inner perimeter side of said outer member, said outer perimeter side of said inner member and said inner perimeter side of said outer member defining an annular space in said central bore adapted for receiving athletic shoes therein.

* * * * *